United States Patent [19]

Cartwright et al.

[11] 4,452,257

[45] Jun. 5, 1984

[54] TREATMENT FOR NATURAL LEAF TOBACCO WRAPPER

[75] Inventors: William F. Cartwright, Manchester; Alan Cornell, Bloomfield, both of Conn.

[73] Assignee: Consolidated Cigar Corp., Secaucus, N.J.

[21] Appl. No.: 346,407

[22] Filed: Feb. 8, 1982

[51] Int. Cl.[3] ..... A24B 15/30

[52] U.S. Cl. ..... 131/310; 131/352; 131/365

[58] Field of Search ..... 131/310, 352, 358, 353–355, 131/365

[56] References Cited

U.S. PATENT DOCUMENTS

| | | | |
|---|---|---|---|
| 2,029,494 | 2/1936 | Lowenthal | 131/352 |
| 2,745,775 | 5/1956 | Freund et al. | 131/352 |
| 2,776,916 | 1/1957 | Ericson | 131/352 |
| 2,840,085 | 6/1958 | Detert | 131/310 |
| 3,000,765 | 9/1961 | Rosenberg | 131/352 |
| 3,310,057 | 3/1967 | Sauage et al. | 131/352 |
| 3,343,546 | 9/1967 | Detert et al. | 131/352 |
| 3,424,169 | 1/1969 | Moren et al. | 131/352 |
| 3,534,743 | 10/1970 | Monte | 131/352 |
| 4,109,663 | 8/1978 | Maeda et al. | 131/352 |
| 4,140,135 | 2/1979 | Godfrey | 131/352 |
| 4,142,535 | 3/1979 | Perkins et al. | 131/352 |
| 4,306,059 | 12/1981 | Yokobayashi et al. | 131/352 |

*Primary Examiner*—V. Millin

*Attorney, Agent, or Firm*—Kontler, Grimes & Battersby

[57] ABSTRACT

A treatment system for natural leaf tobacco wrapper is provided for comprising in combination:

(a) a humectant/plasticizer component;

(b) a preservative component;

(c) a solvent carrier selected from the group comprising water and water/alcohol mixtures; and (d) optionally, a polymeric film-forming component selected from the group comprising synthetic gums, natural gums and protein film-forming compositions.

8 Claims, No Drawings

TREATMENT FOR NATURAL LEAF TOBACCO WRAPPER

A method for the treatment of natural leaf tobacco wrapper to improve resistance to breakage and enhance taste when such is exposed to low humidity conditions comprising applying to such natural leaf tobacco wrapper a treatment system comprising, in combination:

(a) a humectant/plasticizer component;
(b) a preservative component;
(c) a solvent carrier selected from the group comprising water and water/alcohol mixtures; and
(d) optionally, a polymeric film-forming component selected from the group comprising synthetic gums, natural gums and protein film-forming compositions.

BACKGROUND OF THE INVENTION

In the art of manufacturing premium cigars a problem often encountered is the atmospheric changes to which the cigar, and in particular the outer cigar wrapper leaf, is subjected between the factory and the ultimate point of distribution to the consumer.

In many instances the cigar will be subjected to a variety of atmospheric conditions which gradually tend to dry out the wrapper leaf causing the wrapper leaf to become brittle and lose flexibility and resulting in the loss of the preferred feel which cigar smokers look for as indicative of a fresh cigar.

Various packaging systems have been devised including cellophane wrap and the like, in order to slow the drying process and provide cigars with a longer shelf life, or time from manufacture to ultimate use by the consumer, in which the cigar will maintain a fresh feel.

It has been nevertheless found that unless an extremely expensive packaging system is employed which serves to effectively isolate a fresh cigar from the changes in atmospheric conditions, cigars packaged in a normal fashion using cellophane wrap or similar such materials will gradually lose that degree of moisture which is normally thought necessary to affect the freshness and feel desired by the smoking public.

In addition, in many areas of the world, such as for instance, Spain, and the countries of Latin America cigars are preferentially not marketed in a protective wrapper, such as cellophane or other wrapping materials, but rather are boxed in the unwrapped state which is preferred by the smoking public in those countries.

It has, therefore, been found desirable to develop a treatment for natural leaf tobacco wrapper which is incorporated into a cigar product which will allow the resultant cigar wrapper to maintain a fresh feel and taste even after being subjected to drying conditions, even when subsequently wrapped with cellophane or the like. Preferentially, such treated cigars will be able to enjoy an enhanced shelf life even when marketed in the exposed unwrapped condition and yet still maintain the feel and taste associated with a fresh cigar.

Various methods have been suggested by the art for treating tobacco. However, none are directed specifically to the treatment of natural leaf tobacco wrappers for cigars incorporating the specific combination of components utilized in the present invention.

Exemplary of the state of the art of the various methods for treating tobacco products are the following:

U.S. Pat. No. 2,029,494 which issued Feb. 4, 1936 to Loewenthal relates to the treatment of tobacco to improve its appearance and smoking qualities wherein gums, oils, nicotine and other mineral matters are removed from the tobacco leaves which are then impregnated with organic matter and mineral matter to give the tobacco the proper flavor and burning properties. Subsequent to treatment in a hot nitric acid bath leaves, suitable for use as a cigar wrapper, may be subjected to a glycerine treatment and subsequently dried.

This method basically represents a reconstitution scheme which is not economically feasible since it results in excessive additional costs in the manufacture of tobacco products. Furthermore, the intended purpose and benefits to be derived in using a glycerine treatment is not defined in the invention disclosure.

U.S. Pat. No. 2,745,775 which issued on May 15, 1956 to Freund et al. is directed to a method for conditioning tobacco products utilizing lactositol as a conditioning humectant.

There is no disclosure of the primary object of the present invention which is plasticization of a natural leaf tobacco wrapper. Furthermore, the use of glycerine and propylene glycol are mentioned only in the context that they should not be utilized for such applications since they suffer from the disadvantages described by Freund et al.'s teaching. Glycerine, in particular, is noted as giving rise to irritating combustion products which not only adversely affect the general smoking quality but also act upon the flavoring ingredients in the butt portion of the tobacco product, thus undesirably altering the smoking characteristics during the latter stages of the smoking period.

U.S. Pat. No. 2,776,916 which issued on Jan. 8, 1957 to Ericsson is directed to an improved tobacco composition and in particular to an improved tobacco composition involving the use of inorganics as humectants. This teaching specifically excludes the use of glycerine, propylene glycol and the like as tobacco additives.

Contrary to the teachings of this reference it has now been found that the coating of the wrapper leaf with glycerine and/or propylene glycol, at appropriate levels, does not yield the negative attributes which are complained of in distinguishing the inorganic humectant approach taught by Ericsson.

U.S. Pat. No. 3,310,057 which issued on Mar. 21, 1967 to Savage relates to a process for stabilizing tobacco against discoloration during the manufacture of a reconstituted tobacco product.

In carrying out the process of this teaching, a hydrophobic polymer is utilized which is synthesized using glycerine or propylene glycol as a starting material.

The approach taken by Savage is basically different from that disclosed and claimed in the present invention which relies upon the use of a polyol, such as the glycerine or propylene glycol component, which requires some degree of water solubility in order to affect the desired treatment method.

U.S. Pat. No. 3,343,546 which issued on Sept. 26, 1967 to Detert et al. relates to a process for the manufacture of a saliva resistant tobacco sheet which is very resistant toward mechanical stress when in the moist condition.

In contradistinction, the natural leaf tobacco wrapper which has been treated in accordance with the present disclosure will result in a cigar wrapper which will pick up moisture, such as saliva, from the smoker's mouth faster than would be normally expected and would not result in a water resistant wrapper as is disclosed by Detert et al.

In addition, in the present invention water from smoker's saliva also acts as a plasticization agent and the smoker is less likely to notice a fragile wrapper and thus experiences a more pleasant mouthfeel as well.

U.S. Pat. No. 3,424,169 which issued on Jan. 28, 1969 to Moren et al. provides for a process for preparing reconstituted tobacco in sheet form and deals with the use of a polymeric alcohol, such as propylene glycol, as a means of adjusting the gelling temperature of the cellulosic gum.

There is no teaching in this reference of the use of such a material in the context of a humectant/plasticizer for natural leaf tobacco wrapper as is taught in the present invention.

U.S. Pat. No. 3,534,743 which issued on Oct. 20, 1970 to Monte is directed to a reconstituted tobacco material with a hydrophobic coating of a high viscosity nitrocellulose. This basically differs from the approach taken in the present invention which is directed to a coating/impregnation process involving the plasticization of the wrapper leaf which is achieved quickly and employs the use of water soluble materials.

U.S. Pat. No. 4,109,663 which issued on Aug. 29, 1978 to Maeda et al. is directed to a smoking product which is produced by incorporating into a smoking material a polysaccharide, either as the sole smoking material or as its partial replacement. While glycerine, propylene glycol and similar materials are mentioned in this disclosure as having been employed in tobacco products, there is no teaching of the advantages to be achieved by utilizing the treatment system described and claimed in the present invention.

U.S. Pat. No. 4,140,135 which issued on Feb. 20, 1979 to Godfrey, Jr. is directed to a coated tobacco product having a hydrophobic coating comprising a cellulose propionate. The coating composition is applied to a reconstituted tobacco product in a volatile solvent in order to form a water resistant hydrophobic film.

This approach is again basically different from that of the present invention which seeks to impart a treatment system to a natural leaf tobacco wrapper which results in a wrapper having improved characteristics at low moisture and which is not in fact water resistant.

None of the foregoing prior art teachings suggest either the method or the treatment system which is the subject of the present invention, which involves the treatment of natural leaf tobacco wrapper to improve resistance to breakage and to provide enhanced taste when such natural leaf tobacco wrapper is exposed to low humidity conditions.

It is therefore an object of the present invention to provide a treatment system for natural leaf tobacco wrapper which provides the natural leaf tobacco wrapper with the feel of a fresh tobacco leaf wrapper, even under low humidity conditions.

It is another object of the present invention to provide a treatment system which yields a natural leaf tobacco wrapper under low humidity conditions which is substantially less brittle than a similar untreated natural leaf tobacco wrapper exposed to the same low humidity conditions.

It is yet another object of the present invention to provide for a method for the treatment of natural leaf tobacco wrapper which allows one to easily treat such natural leaf tobacco wrapper in order to effectively reduce the brittleness of such a wrapper under low humidity conditions.

It is a further object of the present invention to provide for a treated natural leaf tobacco wrapper which has improved resistance to breakage and enhanced taste when exposed to low humidity conditions as compared to a similar wrapper which has not been treated in accordance with the method of the present invention.

These and other objects of the invention will become more apparent from the following description of the invention.

SUMMARY OF THE INVENTION

In accordance with the present invention a treatment system for natural leaf tobacco wrapper is provided for comprising in combination:

(a) a humectant/plasticizer component;
(b) a preservative component;
(c) a solvent carrier selected from the group comprising water and water/alcohol mixtures; and
(d) optionally, a polymeric film forming component selected from the group comprising synthetic gums, natural gums and protein film-forming compositions.

This invention also provides for a novel method for the treatment of natural leaf tobacco wrapper to improve resistance to breakage and enhance taste when such is exposed to low humidity conditions comprising applying to such natural leaf tobacco wrapper a treatment system comprising, in combination:

(a) a humectant/plasticizer component;
(b) a preservative component;
(c) a solvent carrier selected from the group comprising water and water/alcohol mixtures; and
(d) optionally, a polymeric film forming component selected from the group comprising synthetic gums, natural gums and protein film-forming compositions.

DESCRIPTION OF THE INVENTION

It has been found that the treatment of a natural leaf tobacco wrapper with a treatment system comprising:

(a) a humectant/plasticizer component;
(b) a preservative component;
(c) a solvent carrier selected from the group comprising water and water/alcohol mixtures; and
(d) optionally, a polymeric film-forming component selected from the group comprising synthetic gums, natural gums and protein film-forming compositions, which serves to significantly reduce the brittleness of such leaf when exposed to low humidity conditions.

Additionally, treating a natural leaf tobacco wrapper with the treatment system of the present invention also serves to significantly enhance the taste normally afforded with a tobacco product, incorporating such a natural leaf tobacco wrapper, after such has been exposed to low moisture conditions.

The treatment system of the present invention utilizes the approach of applying either to the natural leaf tobacco wrapper, before incorporating such wrapper into the final tobacco product, or to the surface of the final tobacco product to which such a natural leaf tobacco wrapper has been applied, a humectant/plasticizer composition in admixture with a solvent carrier and a preservative to which may be optionally added a natural or synthetic gum or collagen type film-forming component for additional strength.

The treatment system of the present invention may be applied either by spraying using conventional spraying apparatus or by dipping the finished product in the manner conventionally utilized in the cigar making industry, so long as the desired amount of the humectant/plasticizer component is applied to the wrapper leaf during the course of such treatment.

Preferentially, the treatment system of the present invention will be applied by spraying a suitable amount of a solution containing the humectant/plasticizer, preservative and film-forming components such as to achieve a treatment level of from 5 to 25% by weight of the humectant/plasticizer component based upon the weight of the wrapper leaf treated.

Most preferentially from about 10 to about 20% by weight of the humectant/plasticizer component will be applied to achieve optimum results, with 15% by weight having been determined to achieve an optimum balance between wrapper plasticization and mold susceptibility utilizing the preferred humectant/plasticizer composition.

It has been determined that the presence of a humectant system invariably increases the susceptibility of the resultant cigar product toward mold development under high humidity conditions. Consequently, the use of a preservative has been incorporated in the system of the present invention in order to retard this undesirable mold formation.

The humectant system of the present invention has also been found to ameliorate the astringent bitter characteristic typically associated with dry cigars.

A number of different humectant/plasticizer components may be effectively employed in formulating the treatment system, and in carrying out the treatment process, of the present invention such as for example, glycerine, 1,3-propylene glycol, triethyleneglycol (TEG), 1,3-butyleneglycol, or other recently developed polyols such as POLYOL ® HM-75, POLYOL ® 3070 and POLYOL ® 7000, which are commercially available products manufactured and sold by Lonza of Fairlawn, N.J. 07410. In addition, POLYDEXTROSE ® and POLYDEXTROSE ® Type N, which are commercially available products manufactured and sold by the Pfizer Chemical Company, New York N.Y. 10017, may also be effectively employed.

The preferred humectant/plasticizer to be employed with natural leaf tobacco wrapper has been found to be a composition comprising glycerine in combination with 1,3-propylene glycol in a ratio of from about 2:1 to about 1:1 parts glycerine to 1,3-propylene glycol.

While 1,3-propylene glycol has been found to be less susceptible to mold formation under high humidity conditions, it also achieves a less effective plasticization of the wrapper than does glycerine. However, the combination of the two components in the proportions indicated has been found to yield a optimum balance of good plasticization with relatively low susceptibility to mold formation at high humidity when such a humectant/plasticizer composition is applied as indicated in an amount of approximately 15% by weight of the combined glycerine/1,3-propylene glycol, based upon the weight of tobacco leaf treated.

1,3-butylene glycol, also a mold inhibitor, has been found to have a plasticization effect intermediate between that of glycerine and propylene glycol. At high levels of addition, however, 1,3-butylene glycol tends to impart an off note to the smoke taste.

Sorbitol, which is known to be a good humectant, has been found to impart very little plasticization effect and has also been found to render the treated cigar wrapper quite susceptible to mold growth.

Preservatives to affect the retarding of mold formation at high humidity to be employed may be any preservatives typically used in the food industry, such as parabens, propionates, benzoates, sorbates and similar materials.

The use of sorbic acid as a preservative in combination with the preferred glycerine/1,3-propylene glycol, humectant/plasticizer composition in an alcohol/water carrier has been found to yield the most preferred result. In some instances it may be found to be more convenient to use the corresponding potassium salt (e.g. potassium sorbate).

Preferentially, sorbic acid will be added at a level of 0.1 to 0.6 weight percent based upon the total weight of the wrapper leaf being treated and most preferably such sorbic acid will be utilized in an amount of 0.3 to 0.4 weight percent.

It has also been found that when application of the treatment system of the present invention is to be made only to the head portion of the cigar, that is the portion which the smoker places in his mouth, the humectant/plasticizer of the present invention may be advantageously added to the head paste utilized to glue the natural leaf tobacco wrapper down during the manufacture of the cigar.

While it has been found that the application of the humectant/plasticizer system of the present invention may be made either in an aqueous or in a water/alcohol solvent system, the use of a water/alcohol solvent system is preferred, since it results in a more uniform distribution of the humectant/plasticizer throughout the natural leaf tobacco wrapper.

The water serves to wet out the leaf while the alcohol allows rapid penetration through the natural leaf tobacco wrapper surface wax layer, thereby creating a more uniformly treated wrapper leaf. Water alone may spot the wrapper leaf.

Preferentially, a water/alcohol solvent system utilizing an alcohol selected from the group comprising a low molecular weight aliphatic alcohol, such as methanol, ethanol, propanol, isopropanol and the like will be utilized in the present invention.

The criteria for the selection of an appropriate alcohol, or any solvent carrier, are (1) it must be relatively volatile, so that it may be quickly lost via evaporation; and (2) it must not impart any residual aroma or taste of its own to the tobacco leaf which is treated.

An example of a deficient alcohol would be 1-octanol.

The particular proportions of humectant/plasticizer component to water/alcohol solvent is not critical so long as the amount of water/alcohol solvent employed is sufficient to totally disperse the amount of a humectant/plasticizer which one desires to apply.

Process considerations, such as the type of apparatus utilized to spray the solution on the natural leaf tobacco wrapper, or the length of time in which one wishes to achieve the necessary application of the required weight percent of humectant/plasticizer to the leaf wrapper, in an alternative operation, such as dipping, will determine the precise proportion of humectant/plasticizer to water/alcohol solvent which will be employed in a particular application.

The nature of the present invention will be more clearly understood by recourse to the following examples, which are set forth for illustrative purposes only and are not be construed as limiting the invention thereto.

EXAMPLES

General Comments

Evaluation of humectant/plasticizer effect was carried out by placing cigars in a controlled relative humidity environment at from about 20 to 100% humidity. After equilibrium was reached which normally occurs after 7 days exposure, the wrappers were qualitatively assessed by feel to determine the degree of brittleness.

At higher relative humidity conditions the length of time in which it took to develop mold was monitored.

Various samples of cigars were evaluated by a taste panel for both cold taste and actual taste during smoking.

EXAMPLES I-IX

Samples of Connecticut Shade wrapper leaf were coated with a humectant/plasticizer system of the present invention at a level of 15% by weight of various humectant/plasticizers, both with and without sorbic acid as a mold inhibitor, in an alcohol/water solution. The treated system utilized had the following compositions:

15% humectant/plasticizer (glycerine alone; or 2:1, 1:1 or 1:2 glycerine: 1,3-propylene glycol)
0.1% sorbic acid (preservative)
25% alcohol
59.9% distilled water Where appropriate, the humectant/plasticizer was dissolved in the water and the sorbic acid in the alcohol, the water/humectant/plasticizer and alcohol/sorbic acid solutions were then combined to give the final solution. Application to the leaf was by a lab chromatography sprayer using air pressure. Leaf add-on was 100% giving a 15% by weight add-on of humectant and 0.1% by weight add-on sorbic acid after evaportion of the water and alcohol. When spraying was complete the leaf wrappers were very wet and somewhat sticky.

The resultant leaf wrappers, along with a control wrapper, were then used to manufacture cigars, which were then placed in various relative humidity tanks at the following levels:

43% (effect of drying to 9–10% moisture)
72% (typical of factories)
87% (indication of mold tendencies)
100% (rapid mold assessment)

After conditioning at 43% the cigars were evaluated for wrapper fragility and taste versus control cigars.

The results of these evaluations are set forth in Table 1. The data in Table 1 illustrates that the addition of 15% by weight of glycerine or glycerine/1,3-propylene glycol combinations resulted in a marked improvement of wrapper fragility under dry conditions. The presence of a humectant/plasticizer system increased the susceptibility of the cigars toward mold development under high humidity conditions. Use of sorbic acid retarded, but did not completely eliminate, the tendency toward mold development. It was also noted that propylene glycol is less susceptible to mold but less effective at plasticizing the wrapper than is glycerine.

TABLE 1

EXAMPLES I-IX

| Example # | Description | Mold Susceptibility (1=Best; 10=Worst) | Taste Ranking (1=Best) | Wrapper Fragility (0=Poor; 1=Good) |
|---|---|---|---|---|
| I | Control | 1 | 4 | 0 |
| II | Glycerine-S* | 6 | 2 | 1 |
| III | 2:1**-S | 5 | 1 | 1 |
| IV | 1:1-S | 4 | 2 | 1 |
| V | 1:2-S | 2 | 3 | 1 |
| VI | Glycerine | 10 | — | 1 |
| VII | 2:1 | 8 | 1 | 1 |
| VIII | 1:1 | 7 | — | 1 |
| IX | 1:2 | 6 | — | 1 |

*S=sorbic acid (0.1%) present.
**Ratio of glycerine : 1,3-propylene glycol.

In terms of taste, the humectant/plasticizer systems ameliorated the astringent, bitter characteristics typically associated with dry cigars. The presence of sorbic acid did not affect taste. The taste of cigars having wrappers coated with either 2:1 or 1:1 glycerine: 1,3-propylene glycol were preferred.

While the invention has been described with reference to a number of embodiments, it will be apparent to one skilled in the art that there are additional numerous variations which properly fall within the range of this invention. Therefore, it should be understood that the foregoing embodiments and examples are set forth to illustrate the advantages which may be achieved utilizing the present invention and should not be interpreted as limiting the scope of the invention.

We claim:

1. A treatment system for natural leaf tobacco wrappers comprising, in combination:

(a) a humectant/plasticizer component comprising a combination of glycerine and 1,3-propylene glycol in an amount between about 10% and about 20% based upon the weight of the natural leaf tobacco wrapper;

(b) a preservative component selected from the group consisting of sorbic acid, parabens, propionates, benzoates and sorbates and in an amount between about 0.1% and about 0.6% by weight based on the weight of the natural leaf wrapper;

(c) a water/alcohol mixture solvent carrier comprising water and an alcohol selected from the group consisting of methanol, ethanol, propanol and isopropanol; and (d) a collagen-type film-forming component.

2. A treatment system according to claim 1 wherein the humectant/plasticizer component is present in an amount of about 15% by weight based upon the weight of the natural leaf tobacco wrapper.

3. A treatment system according to claim 1 wherein the preservative component is selected from the group consisting of sorbic acid and potassium sorbate.

4. A treatment system according to claim 1 wherein the preservative component is present in an amount from about 0.3 to 0.4% by weight based upon the weight of the natural leaf tobacco wrapper.

5. A method for the treatment of natural leaf tobacco wrappers to improve resistance to breakage and enhance taste when such is exposed to low humidity conditions, said method comprising the steps of applying to such normal leaf tobacco wrappers a treatment system comprising, in combination:

(a) a humectant/plasticizer component comprising a combination of glycerine and 1,3-propylene glycol in an amount between about 10% and about 20% based upon the weight of the natural leaf tobacco wrapper;

(b) a preservative component selected from the group consisting of sorbic acid, parabens, propionates, benzoates and sorbates and in an amount between about 0.1% and about 0.6% by weight based on the weight of the natural leaf wrapper;

(c) a water/alcohol mixture solvent carrier comprising water and an alcohol selected from the group consisting of methanol, ethanol, propanol and isopropanol; and (d) a collagen-type film-forming component.

6. A method according to claim 5 wherein the preservative component in the treatment system is selected from the group consisting of sorbic acid and potassium sorbate.

7. A method according to claim 5 wherein the humectant/plasticizer component in the treatment system is present in an amount of about 15% by weight based upon the weight of the natural leaf tobacco wrapper.

8. A method according to claim 5 wherein the preservative component in the treatment system is present in an amount from about 0.3 to 0.4% by weight based upon the weight of the natural leaf tobacco wrapper.

* * * * *